US008428291B2

(12) United States Patent
Lin et al.

(10) Patent No.: US 8,428,291 B2
(45) Date of Patent: Apr. 23, 2013

(54) SPEAKER SYSTEM WITH SUBWOOFER

(75) Inventors: Shi-Quan Lin, Shenzhen (CN); Te-Hua Lee, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 345 days.

(21) Appl. No.: 12/821,343

(22) Filed: Jun. 23, 2010

(65) Prior Publication Data

US 2011/0243359 A1 Oct. 6, 2011

(30) Foreign Application Priority Data

Mar. 31, 2010 (CN) ..... 2010 1 0137035

(51) Int. Cl.
*H04R 1/20* (2006.01)

(52) U.S. Cl.
USPC ..... 381/388; 181/198

(58) Field of Classification Search ..... 181/198, 181/199; 381/338
See application file for complete search history.

(56) References Cited

U.S. PATENT DOCUMENTS

| | | | | |
|---|---|---|---|---|
| 4,168,761 | A * | 9/1979 | Pappanikolaou | 181/156 |
| 4,298,087 | A * | 11/1981 | Launay | 181/153 |
| 5,010,977 | A * | 4/1991 | Furukawa et al. | 381/96 |
| 5,821,471 | A * | 10/1998 | McCuller | 181/156 |
| 6,062,338 | A * | 5/2000 | Thompson | 181/152 |
| 6,618,488 | B2 * | 9/2003 | Nakamura | 381/349 |
| 2001/0005422 | A1 * | 6/2001 | Nakamura | 381/349 |
| 2008/0159554 | A1 * | 7/2008 | Sung et al. | 381/71.6 |
| 2011/0243359 | A1 * | 10/2011 | Lin et al. | 381/338 |

* cited by examiner

*Primary Examiner* — Jeffrey Donels
(74) *Attorney, Agent, or Firm* — Altis Law Group, Inc.

(57) ABSTRACT

A speaker system includes an enclosure defining a resonance chamber, a loudspeaker received in the resonance chamber, and a sound wave reflecting member. The enclosure includes a front panel and a base. The loudspeaker is exposed at the front panel. The base includes a back panel facing the front panel, an inner tube, and an outer tube. The back panel defines a back bass port. The inner tube and the outer tube extend from the back panel and are received in the resonance chamber. The inner tube surrounds the back bass port. The outer tube surrounds the inner tube. The sound wave reflecting member is coupled with the outer tube and the inner tube. The sound wave reflecting member, the outer tube, and the inner tube cooperatively form a resonator. The resonator communicates with the resonance chamber and the back bass port.

18 Claims, 4 Drawing Sheets

SPEAKER SYSTEM WITH SUBWOOFER

BACKGROUND

1. Technical Field

The present disclosure relates to speaker systems and, particularly, to a speaker system having subwoofer.

2. Description of Related Art

Generally, a speaker system includes an enclosure and a loudspeaker. The enclosure defines a resonance chamber. The loudspeaker is positioned in the resonance chamber and is configured for converting electric energy to generate sound waves. When the loudspeaker is activated, the sound waves generated by the loudspeaker enter into the resonance chamber and are resonated to amplify the sound. As a result, the low frequency effect of the speaker system is captured. Moreover, the larger size the resonance chamber has the better low frequency effects of the speaker system. However, there is also an ongoing trend for the speaker system to be miniaturized. Therefore, the lower frequency effect of miniaturized speaker system only depending on the resonance chamber cannot meet people's demands.

Therefore, it is desirable to provide a speaker system with subwoofer, which can overcome or at least alleviate the above-mentioned problems.

DETAILED DESCRIPTION

Figure 1:
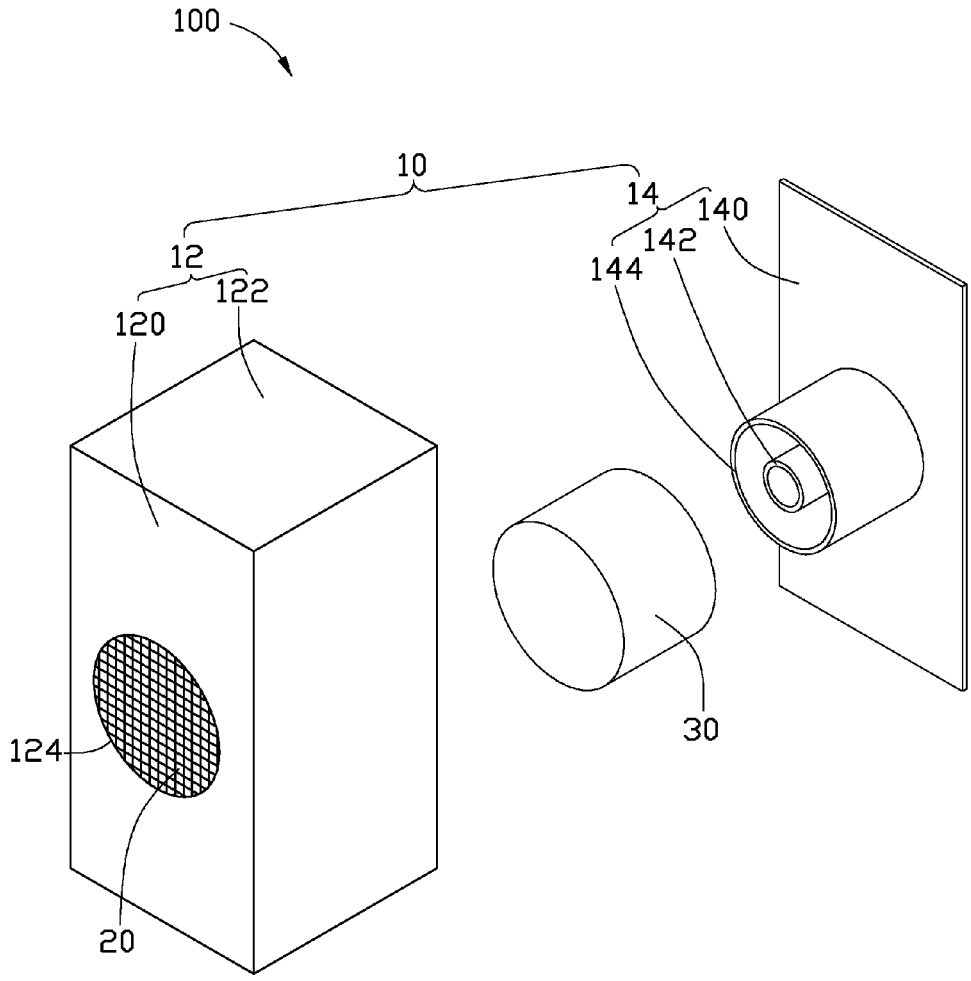
FIG. 1 is an exploded, isometric view of a speaker system including a sound wave reflecting member, according to an exemplary embodiment.
Figure 2:
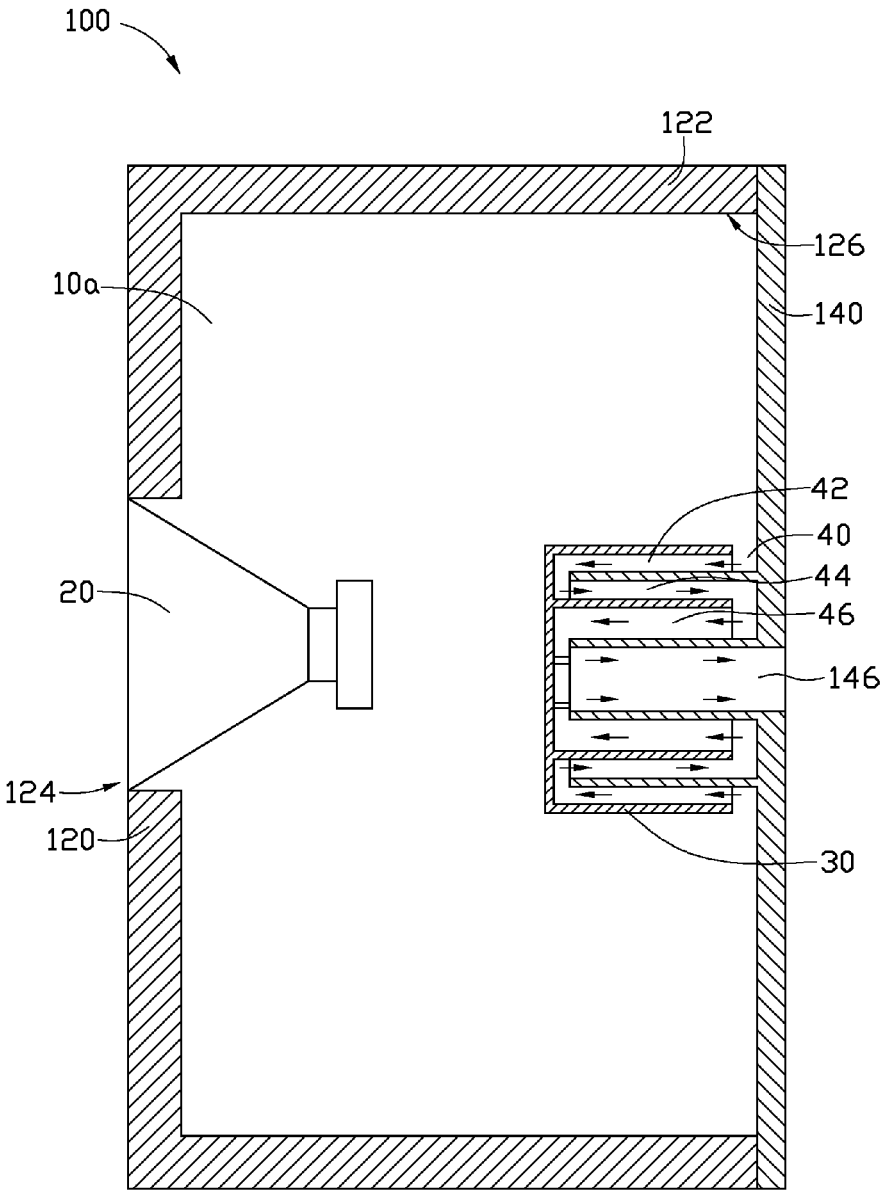
FIG. 2 is a sectional view of the speaker system of FIG. 1.

Referring to FIGS. 1-2, a speaker system 100, according to an exemplary embodiment, is used in electronic devices, such as mobile phones, computers, and other electronic devices providing audio capabilities. The speaker system 100 includes an enclosure 10, a loudspeaker 20, and a sound wave reflecting member 30.

The enclosure 10 may be made of plastic or alloy. The enclosure 10 is substantially cuboid and defines a resonance chamber 10*a*. The enclosure 10 includes a cover 12 and a base 14.

The cover 12 has a rectangular cross-section. The cover 12 includes a front panel 120 and four sidewalls 122 extending from the front panel 120. The front panel 120 defines a front hole 124. The four sidewalls 122 surround the front panel 120 to form an opening 126.

The base 14 includes a back panel 140, an inner tube 142 extending from the back panel 140, and an outer tube 144 extending from the back panel 140. The back panel 140 defines a back bass port 146 corresponding to the front hole 124. The inner tube 142 surrounds the back bass port 146. The outer tube 144 spatially surrounds the inner tube 142. The back panel 140 seals the opening 126 to form the resonance chamber 10*a*. The inner tube 142 and the outer tube 144 are positioned in the resonance chamber 10*a*. In this embodiment, the diameter of the inner tube 142 is substantially equal to that of the back bass port 146. The length of the inner tube 142 is substantially equal to that of the outer tube 144. The inner tube 142 and the outer tube 144 are integrally formed with the back panel 140. In other embodiments, the inner tube 142 and the outer tube 144 may be formed separately and then are mounted to the back panel 140.

The loudspeaker 20 is mounted to the front panel 120 and received in the resonance chamber 10*a*. The loudspeaker 20 is exposed at the front panel 120 through the front hole 124 and is opposite to the inner tube 142 and the outer tube 144.

Figure 3:
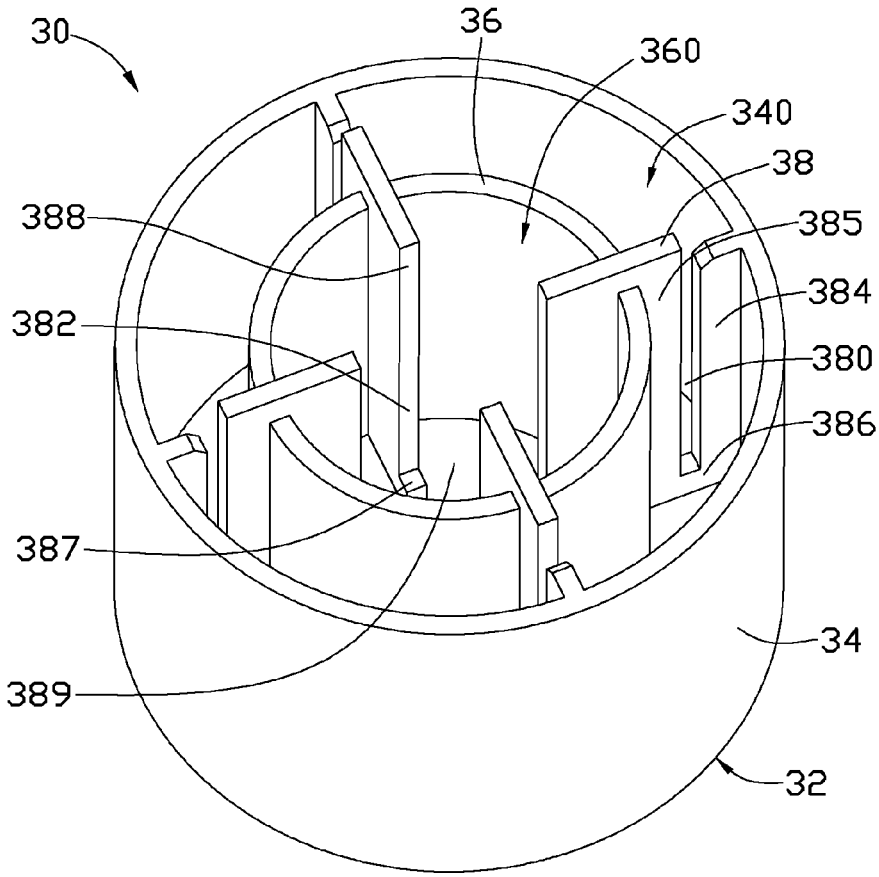
FIG. 3 is a schematic, isometric view of the sound wave reflecting member of FIG. 1.
Figure 4:
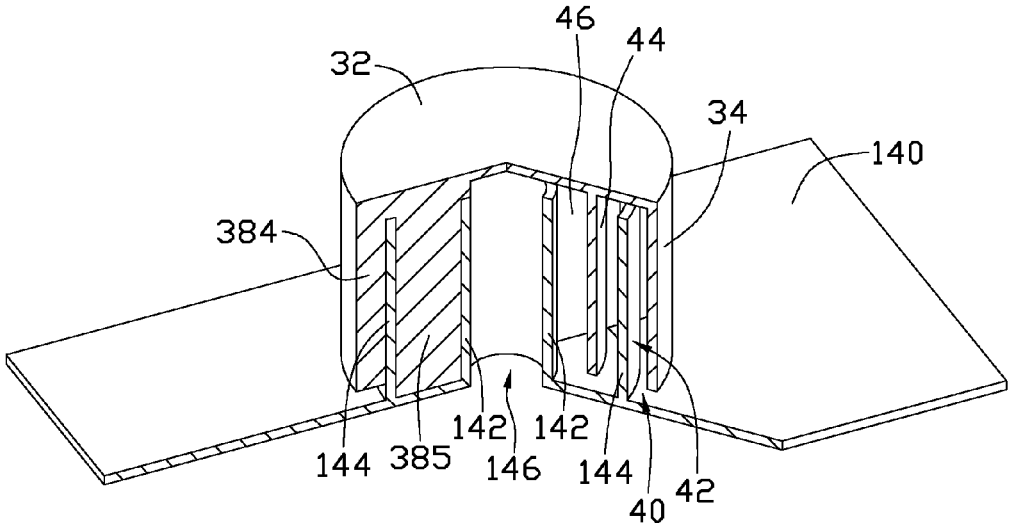
FIG. 4 is a partial, cut away view of the speaker system of FIG. 1.

Referring to FIGS. 3-4, the sound wave reflecting member 30 includes a bottom panel 32, an outer barrel 34, an inner barrel 36 defining a first receiving room 360, and four boards 38. The outer barrel 34, the inner barrel 36, and the four boards 38 extend from the bottom panel 32. The inner barrel 36 is received in the outer barrel 34 and coaxial with the outer barrel 34. The outer barrel 34 and the inner barrel 36 cooperatively form a second receiving room 340 therebetween. The four boards 38 are substantially equidistantly spaced from each other around the center axis of the outer barrel 34. Each board 38 extends from an inner surface 342 of the outer barrel 34 and passes through the second receiving room 340 to protrude into the first receiving room 360.

A slot 380 and a cutout 382 are defined in each board 38 along the central axis of the outer barrel 34. The slot 380 extends from the back panel 140 towards the bottom panel 32 but is not in contact with the bottom panel 32. The cutout 382 is positioned in the first receiving room 360 on the distal end of the board 38. Therefore, each board 38 is divided into a first blocking portion 384, a second blocking portion 385, a connecting portion 386, and a supporting portion 387. The slot 380 is located between the first blocking portion 384 and the second blocking portion 385. The connecting portion 386 connects the first blocking portion 384 to the second blocking portion 385. The supporting portion 387 extends from a side surface 388 of the second blocking portion 385. The four supporting portions 387 and the four side surfaces 385 cooperatively form a third receiving room 389. In this embodiment, the lengths of the outer barrel 34, the inner barrel 36, and the first blocking portion 384 are substantially the same. The length of the second blocking portion 385 is greater than that of the inner barrel 36.

When the sound wave reflecting member 30 is coupled with the base 14, the outer tube 144 is received in the second receiving room 340 and engages in the four slots 380 to contact the connecting portions 386. The inner tube 142 is received in the third receiving room 389. The inner tube 142 contacts the supporting portions 387 and the four side surfaces 388. After the sound wave reflecting member 30 is coupled to the base 14, a space 40 is formed between the sound wave reflecting member 30 and the back panel 140. Between the two boards 38, a resonator is formed. In particular, the resonator includes a first resonance passage 42, a second resonance passage 44, and a third resonance passage 46. The first resonance passage 42 is formed between the outer barrel 34 and the outer tube 144, the second resonance passage 44 is formed between the outer tube 144 and the inner barrel 36, and the third resonance passage 46 is formed between the inner barrel 36 and the inner tube 142. The second resonance passage 44 communicates with the first resonance passage 42 and the third resonance passage 46. The third resonance passage 46 communicates with the back bass port 146 through the inner tube 142.

When the loudspeaker 20 is activated, the loudspeaker 20 generates sound waves toward the front hole 124 and the resonance chamber 10*a*. In particular, sound waves entered into the resonance chamber 10*a* pass through the space 40, the first resonance passage 42, the second resonance passage 44, the third resonance passage 46, and the inner tube 142 and finally propagate out of the enclosure 10 through the back bass port 146. Thus, sound is amplified by the repetitious resonance in the resonance chamber 10*a*, the first resonance passage 42, the second resonance passage 44, the third resonance passage 46, and the inner tube 142. Therefore, the low frequency effect of the speaker system is improved while the speaker system 100 is kept compact.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A speaker system, comprising:

a loudspeaker;

an enclosure defining a resonance chamber, the enclosure comprising a front panel and a base, the loudspeaker received in the resonance chamber and exposed at the front panel, the base comprising a back panel opposite to the front panel, an inner tube, and an outer tube, the back panel defining a back bass port, the inner tube and the outer tube extending from the back panel and received in the resonance chamber, the inner tube surrounding the back bass port, the outer tube surrounding the inner tube; and a sound wave reflecting member comprising a bottom panel, an outer barrel, an inner barrel defining a first receiving room, and four boards, the outer barrel, the inner barrel, and the four boards extending from the bottom panel, the inner barrel received in the outer barrel and coaxial with the outer barrel, the inner barrel and the outer barrel cooperatively forming a second receiving room therebetween, the four boards substantially equidistantly spaced from each other around a center of the outer barrel, each board extending from an inner surface of the outer barrel and passing through the second receiving room to the first receiving room, the sound wave reflecting member coupled with the outer tube and the inner tube, the first receiving room receiving the inner tube, the second receiving room receiving the outer tube, the sound wave reflecting member, the outer tube, and the inner tube cooperatively forming a resonator, the resonator communicating with the resonance chamber and the back bass port.

2. The speaker system as claimed in claim 1, wherein the enclosure is substantially cuboid and comprises the base and a cover attached to the base, the cover has a rectangular cross-section and comprises the front panel and four sidewalls extending from the front panel, a front hole is defined in the front panel, the four sidewalls surround the front panel to form an opening, and the loudspeaker is mounted to the front panel and exposed at the front panel through the front hole.

3. The speaker system as claimed in claim 2, wherein the back panel seals the opening to form the resonance chamber, and the back bass port is opposite to the front hole.

4. The speaker system as claimed in claim 1, wherein the enclosure is made of plastic or alloy.

5. The speaker system as claimed in claim 1, wherein the diameter of the inner tube is substantially equal to that of the back bass port.

6. The speaker system as claimed in claim 1, wherein the length of the outer tube is substantially equal to that of the inner tube.

7. The speaker system as claimed in claim 1, wherein a slot and a cutout are defined in each board along a central axis of the outer barrel, the slot is located in the second receiving room, and the cutout is located in the first receiving room.

8. The speaker system as claimed in claim 7, wherein each board comprises a first blocking portion, a second blocking portion spaced from the first blocking portion, a connecting portion received in the second receiving room, and a supporting portion received in the first receiving room, the first blocking portion extends from the inner surface of the outer barrel, the connecting portion connects the first blocking portion to the second blocking portion, the first blocking portion, the second blocking portion, and the connecting portion cooperatively define the slot, the supporting portion extends from a side surface of the second blocking portion, and the second blocking portions and the supporting portions cooperatively form a third receiving room to receive the inner tube.

9. The speaker system as claimed in claim 8, wherein the length of the outer barrel, the inner barrel, and the first blocking portion are substantially the same, and the length of the second blocking portion is greater than that of the inner barrel.

10. The speaker system as claimed in claim 8, wherein the outer tube engages in the slots and contacts the connecting portion, and the inner tube contacts the supporting portions and the side surfaces of the second blocking portions.

11. The speaker system as claimed in claim 10, wherein the resonator comprises a first resonance passage, a second resonance passage, and a third resonance passage, the first resonance passage is formed between the outer barrel and the outer tube, the second resonance passage is formed between the outer tube and the inner barrel, the third resonance passage is formed between the inner barrel and the inner tube, the second resonance passage communicates with the first resonance passage and the third resonance passage, and the third resonance passage communicates with the back bass port through the inner tube.

12. A speaker system, comprising:

an enclosure defining a resonance chamber, the enclosure comprising a front panel and a base, the base comprising a back panel opposite to the front panel, an inner tube, and an outer tube, the back panel defining a back bass port, the inner tube and the outer tube extending from the back panel toward the front panel and received in the resonance chamber, the inner tube surrounding the back bass port, the outer tube surrounding the inner tube;

a loudspeaker received in the resonance chamber and exposed at the front panel, the loudspeaker configured for generating sound waves toward the resonance chamber; and a sound wave reflecting member positioned between the front panel and the back panel in the resonance chamber and coupled with the outer tube and the inner tube, the sound wave reflecting member, the outer tube, and the inner tube cooperatively forming a resonator, the resonator communicating with the resonance chamber and the back bass port, the sound waves first reflected by the back panel toward the resonator, and then passing through the resonator, and finally propagating out of the enclosure through the back bass port.

13. The speaker system as claimed in claim 12, wherein the enclosure is substantially cuboid and further comprises a cover attached to the base, the cover has a rectangular cross-section and comprises the front panel and four sidewalls extending from the front panel, a front hole is defined in the front panel, the four sidewalls surround the front panel to form an opening, and the loudspeaker is mounted to the front panel and exposed at the front panel through the front hole.

14. The speaker system as claimed in claim 13, wherein the back panel seals the opening to form the resonance chamber, and the back bass port is opposite to the front hole.

15. The speaker system as claimed in claim 12, wherein the enclosure is made of plastic or alloy.

16. The speaker system as claimed in claim 12, wherein the diameter of the inner tube is substantially equal to that of the back bass port.

17. The speaker system as claimed in claim 12, wherein the length of the outer tube is substantially equal to that of the inner tube.

18. The speaker system as claimed in claim 12, wherein the resonator comprises a first resonance passage, a second resonance passage, and a third resonance passage, the first resonance passage is formed between the outer barrel and the outer tube, the second resonance passage is formed between the outer tube and the inner barrel, the third resonance passage is formed between the inner barrel and the inner tube, the second resonance passage communicates with the first resonance passage and the third resonance passage, and the third resonance passage communicates with the back bass port through the inner tube.

* * * * *